US008893935B2

(12) United States Patent
Paez

(10) Patent No.: US 8,893,935 B2
(45) Date of Patent: Nov. 25, 2014

(54) GARMENT FRAME APPARATUS AND SYSTEM

(71) Applicant: Eduardo Paez, Delray Beach, FL (US)

(72) Inventor: Eduardo Paez, Delray Beach, FL (US)

( * ) Notice: Subject to any disclaimer, the term of this patent is extended or adjusted under 35 U.S.C. 154(b) by 0 days.

(21) Appl. No.: 14/034,973

(22) Filed: Sep. 24, 2013

(65) Prior Publication Data

US 2014/0091114 A1 Apr. 3, 2014

Related U.S. Application Data

(60) Provisional application No. 61/704,718, filed on Sep. 24, 2012.

(51) Int. Cl.

| | |
|---|---|
| ***A47H 33/00*** | (2006.01) |
| ***D06F 89/02*** | (2006.01) |
| ***A45C 13/03*** | (2006.01) |
| ***B65D 85/18*** | (2006.01) |
| ***A47G 25/00*** | (2006.01) |
| *B65B 25/20* | (2006.01) |

(52) U.S. Cl.

CPC ..... *D06F 89/023* (2013.01); *A45C 13/03* (2013.01); *B65D 85/182* (2013.01); *A47G 25/00* (2013.01)

USPC ..... 223/37

(58) Field of Classification Search

USPC ..... 223/30, 33, 37, 38, 71, 89; 206/284, 206/296, 494; 229/87.15, 87.17

See application file for complete search history.

(56) References Cited

U.S. PATENT DOCUMENTS

| | | | | |
|---|---|---|---|---|
| 1,720,679 | A * | 7/1929 | Karn | 206/295 |
| 1,838,262 | A * | 12/1931 | Kabins | 223/71 |
| 2,269,915 | A * | 1/1942 | Porter | 229/87.15 |
| 2,487,761 | A | 2/1948 | McFall et al. | |
| 2,988,251 | A | 6/1961 | Ziegler | |
| 4,874,092 | A * | 10/1989 | Lara | 206/455 |
| 5,011,052 | A | 4/1991 | Craig | |
| 5,131,574 | A | 7/1992 | Usco et al. | |
| 5,154,329 | A | 10/1992 | Dorfmueller | |
| 5,947,366 | A | 9/1999 | Feldmann et al. | |
| 5,961,033 | A | 10/1999 | Wang | |
| 6,237,761 | B1 * | 5/2001 | Godshaw et al. | 206/297 |
| 6,279,791 | B1 | 8/2001 | Betman et al. | |
| 6,360,927 | B1 | 3/2002 | Barker | |
| 6,457,635 | B1 * | 10/2002 | Scicluna | 229/87.17 |
| 6,561,392 | B2 * | 5/2003 | Lapace et al. | 223/37 |
| 6,685,065 | B1 * | 2/2004 | Ebling et al. | 223/38 |
| 6,814,269 | B1 * | 11/2004 | Fernandez | 223/37 |
| 7,565,787 | B2 | 7/2009 | Licari | |
| 8,011,170 | B2 | 9/2011 | Smith et al. | |
| 2004/0026273 | A1 * | 2/2004 | Rucco | 206/297 |

* cited by examiner

*Primary Examiner* — Ismael Izaguirre
(74) *Attorney, Agent, or Firm* — Allen F. Bennett

(57) ABSTRACT

A frame for facilitating storage, transport, stacking and organizing garments includes four panels linearly aligned and connected by folds or creases. The rear panel has two flaps extending transversely. The frame is integrated with a shirt when folding such that the front panel positions the front of the shirt on the front of the folded frame. The flaps extend across the front of the shirt and detachably engage to secure the shirt in a semi-rigid state having a cuboid shape. The cuboid shape is maintained by the frame and facilitates stacking, organizing, transport and storage.

19 Claims, 3 Drawing Sheets

Fig. 8
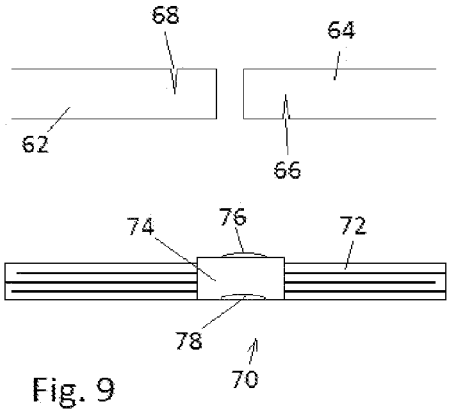
Fig. 9
Fig. 10
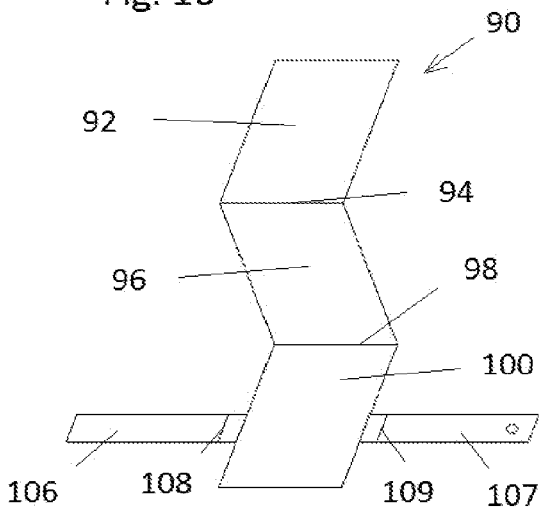
Fig. 11
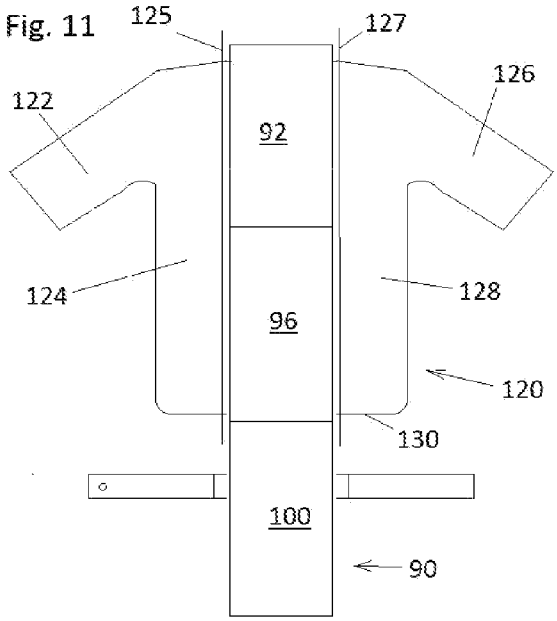
Fig. 12
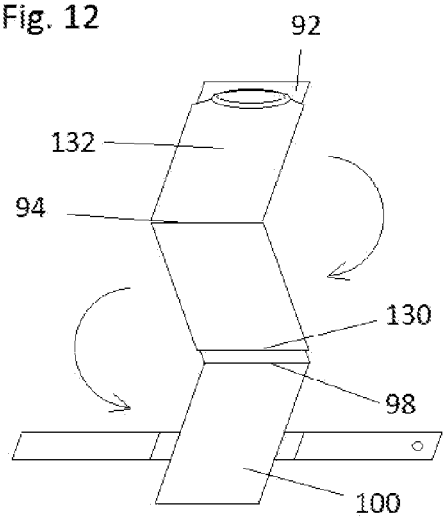

GARMENT FRAME APPARATUS AND SYSTEM

CROSS-REFERENCE TO RELATED APPLICATIONS

This application claims priority to U.S. Provisional Application Ser. No. 61/704,718, filed Sep. 24, 2012, the contents of which are hereby incorporated in its entirety.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

1. Field of Endeavor

The present invention relates to a frame for storing and organizing a garment. More particularly, the present invention provides an apparatus and system for folding, stacking, displaying, storing and organizing a shirt or other clothing in a manner that prevents wrinkling of the garment.

2. Background

It is often desirable to have garments, for example shirts, t-shirts, dress shirts, sweaters, pants, jackets and other articles of clothing that are smooth and without wrinkles. Wearing wrinkled clothing presents a poor image unsuitable in almost all social and business environments.

In an ideal world, there would be unlimited closet space where garments such as shirts, blouses, sweaters, sweatshirts, pants, etc. would be hung on thick padded hangers with sufficient space between the hangers to avoid having the garments touching. However closet space is often limited and clothing on hangers are tightly squeezed against each other, or folded and stuffed into drawers. Unless a person is accessing only the top item in a drawer, the items stored above a lower item must be carefully removed and often re-folded to avoid having all the items pull out and/or become wrinkled.

Storage causes wrinkling of as the articles of clothing (garments) move against one another, producing wrinkles in the fabric that will set in. It is also generally necessary to store these various garments economically within drawers, suitcases, boxes, on shelves and in other places. Often, folding of garments results in creases throughout the garment. Further, constant shuffling of garments, while searching for a particular one, rearranging or transferring garments from one place to another results in wrinkles throughout the garment. Because garments, even while folded, are typically supple and nonrigid, they are highly susceptible to wrinkling even when care is taken. This requires additional ironing of garments. It also makes transferring, transporting, storing and organizing garments difficult and frustrating.

These problems are also known in the retail clothing sales industry, where shoppers continuously unfold garments to view them or try them on and then return the garments to a display shelf without properly refolding the garment. Further, shoppers generally rifle through stacks of garments for sale, creating wrinkles in most or all the garments on an entire shelf. As a result retail sales persons have an increased work load and additional stress.

It is therefore desirable to provide an apparatus and system to allow a clothing article to keep its folded form and prevent unwanted wrinkles in the clothing article.

It is also desirable to provide an apparatus and system to allow a clothing article to keep its folded form and prevent unwanted wrinkles from forming in the clothing article when the clothing article is folded.

It is also desirable to provide and apparatus and system to allow a clothing article to keep its folded form and store, organize, display, transport and transfer garments while preventing unwanted wrinkles from forming in the clothing article when the clothing articles are placed in storage or transit.

BRIEF SUMMARY OF THE INVENTION

Accordingly, the primary object of the present invention is to provide a garment frame for neatly and efficiently stacking and storing garments.

In one embodiment of the invention, a frame to be integrated with a garment comprises a front panel, a secondary panel, a tertiary panel, a rear panel and two flaps extending transversely from the rear panel. The front panel, secondary panel, tertiary panel, and rear panel are connected by folds. The flaps have a structure and/or pads for facilitating removable engagement. The frame may be of unitary design with creases in the material comprising the folds separating the panels. The flaps may be rigid or supple. The frame may incorporate ornamentation such as trademarks or logos and may incorporate odiferous materials to repel insects or to improve the smell of clothing integrated with the frame.

It is therefore an object of the present invention to provide a simple, cheap and convenient folding device suitable for fast and easy folding and storing of garments and apparel and to prevent wrinkling.

It is another object of the present invention is to provide a folding device which can be easily manipulated by any person without the necessity for professional training or special skills.

It is another object of the invention is to provide a folding device suitable for folding and storing garments and apparel in a compact folded configuration inside suitcases, briefcases, bags and other small volume places, while preventing wrinkling.

It is another object of the invention to provide a means of storing and stacking garments and apparel such that they may be viewed and identified without unfolding it or other adjacent garments or apparel.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 8 is a front view of an alternative embodiment of the flaps in accordance with the principles of the present invention;

FIG. 9 is a side view of an alternative embodiment of the frame in accordance with the principles of the present invention;

FIG. 10 is perspective view of an alternative embodiment of a garment frame in accordance with the principles of the present invention;

FIG. 11 is a is rear view of an alternative embodiment of a garment frame with a shirt in accordance with the principles of the present invention;

FIG. 12 is a perspective view of an alternative embodiment of a garment frame partially integrated with a shirt in accordance with the principles of the present invention.

DETAILED DESCRIPTION

Figure 1:
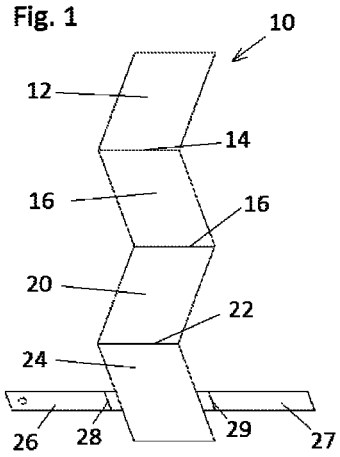
FIG. 1 is a perspective view of a garment frame in accordance with the principles of the present invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

FIG. 1 shows a garment frame 10 comprised of several panels. The front panel 12 is attached at a transverse fold 14 to the secondary panel 16. The secondary panel 16 is attached at a transverse fold 18 to the tertiary panel 20. The tertiary panel 20 is attached at a transverse fold 22 to the rear panel 24. The rear panel 24 includes two flaps 26 and 27 each having a fold 28 and 29 respectively. The frame may optionally have a single, unitary body, comprised of s single piece of material. The frame 10 may be comprised of a substantially rigid material such as metal or wood or may be of semi-rigid material such as cardboard, reinforced cardboard, posterboard, or plastic.

Optionally, the frame 10 may be constructed of different materials which may comprise various components of the frame 10. For example, a solid, rigid material may be covered with padding, an elastomer or cloth material to comprise the frame 10. Optionally each of the panels 12, 16, 20 and 24 of the frame 10 may be comprised of a square wire or other solid material and covered in a material to form a rectangular shape. Each of the folds may be a crease in the material such that the frame 10 may be of unitary design. For example, the frame 10 may be comprised of plastic, where the panels are sufficiently thick to make them suitably rigid, while the transverse folds may be comprised of the same plastic, but substantially thinner and thus flexible. Optionally, the folds 14, 18, 22 and 28 may be comprised of a flexible material connected to panels made of a more rigid material. Optionally, the folds may be hinges or other pivotable or rotatable mechanisms.

Figure 2:
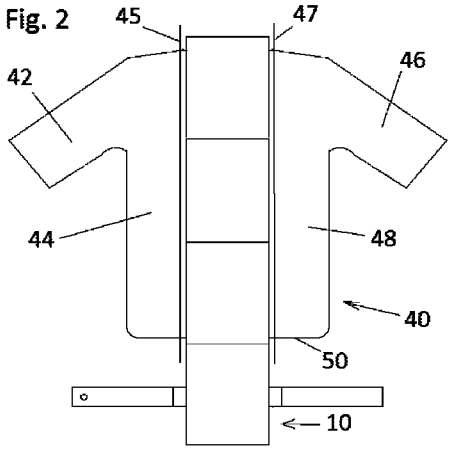
FIG. 2 is rear view of a garment frame with a shirt in accordance with the principles of the present invention.

FIG. 2 shows the frame laid across the back of a shirt 40 having a sleeve 42 on a first side 44 and a sleeve 46 on a second side 48. In this embodiment, the frame 10 is placed on the back of the shirt 40 such that the first side 44 is the left side and the second side 48 is the right side. Optionally, the frame 10 may be placed upon the front of the shirt 40 and the shirt may be folded inverse to the manner illustrated in this Figure. Frame 10 may placed longitudinally along the back of the shirt 42. The frame 10 may have a length such that the fold 22 between the tertiary panel 20 and the rear panel 24 may be located just below the bottom 50 of the shirt. Optionally, the shirt bottom 50 may extend past the fold 22.

Figure 3:
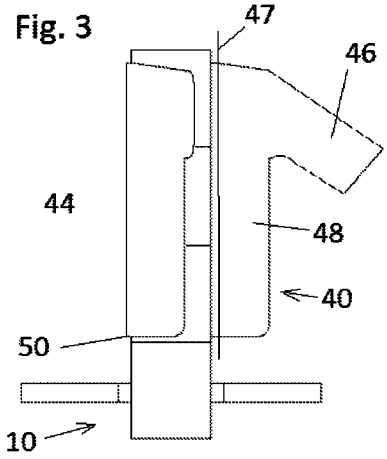
FIG. 3 is a rear view of a garment frame partially integrated with a shirt in accordance with the principles of the present invention.
Figure 4:
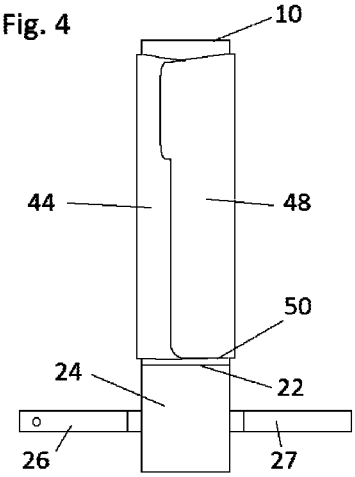
FIG. 4 is a rear view of a garment frame partially integrated with a shirt in accordance with the principles of the present invention.

FIG. 3 shows the first side 44 folded over the frame 10 along the first crease 45 shown in FIG. 2. The sleeve 42 may be folded between the side 44 and the frame 10. Optionally, the sleeve 42 may be folded on the outside of the shirt side 46. Optionally, the frame may be wider such that it may provide sufficient room such that the sleeve may not need to be folded over or under the side 44. FIG. 4 shows the second side 48 folded over the first side 44 along the second crease 47 shown in FIG. 2. Folding along creases 45 and 47 may result in the total width of the shirt folded about the frame 10 only slightly wider than the width of frame 10 itself.

Figure 5:
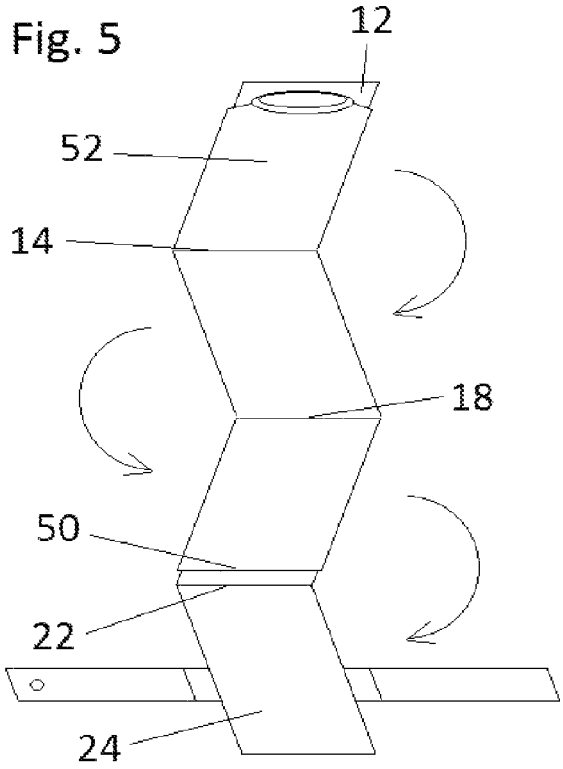
FIG. 5 is a perspective front view of a garment frame partially integrated with a shirt in accordance with the principles of the present invention.

FIG. 5 shows how the frame 10 may be folded along the folds 14, 18 and 22. The front 52 of shirt 40 may be located on the front side of front panel 12. The secondary panel 16 may be folded along fold 14 about 180 degrees such that it may be flush with the front panel 12. The tertiary panel 20 may then be similarly folded along fold 18 approximately 180 degrees, but may be pivoted along the fold in the opposite direction such that it may be flush with the secondary panel 16 and not the front panel 12. Rear panel 24 may also be similarly folded along fold 22 approximately 180 degrees such that it may be flush with the tertiary panel 20.

Figure 6:
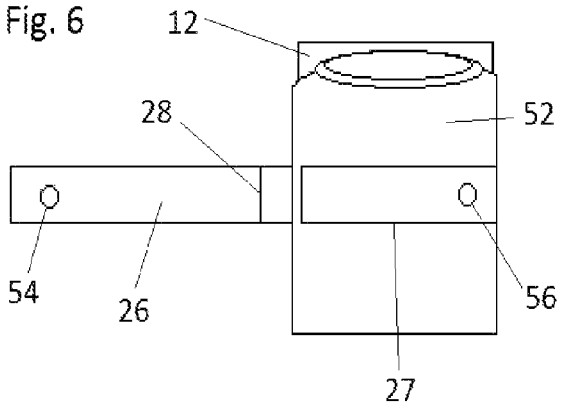
FIG. 6 is front view of a garment frame partially integrated with a shirt in accordance with the principles of the present invention.
Figure 7:
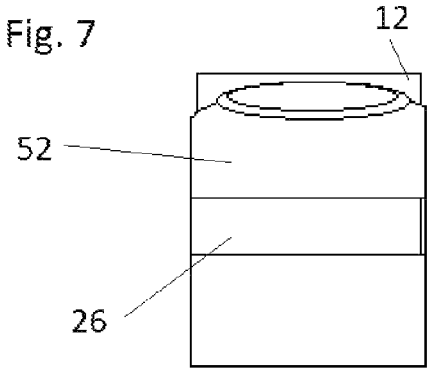
FIG. 7 is front view of a garment frame integrated with a shirt in accordance with the principles of the present invention.

Once the panels 12, 16, 20 and 24 are folded together, they may lie flush with the front panel 12 on top and the rear panel 24 on the bottom as shown in FIG. 6. In FIG. 6, flap 27 has been folded over the shirt and integrated frame 10. When flap 26 is folded over flap 27, as shown in FIG. 7, pads 54 and 56 engage to hold the flaps in place over the front panel 12 and associated shirt 40. Pads 54 and 56 may be comprised of any suitable structure or mechanism for detachable engagement, for example, the pads may use hook and loop mechanism, tongue and groove structure, one or more snaps, magnets, or the like.

The frame may be similarly used for long-sleeve shirts, sweaters, coats, jackets, dress shirts, vests or other garments. The final geometric shape of the shirt with integrated frame as shown in FIG. 7 is substantially a cuboid parallelepiped. As a result, it may facilitate economic, efficient and flexible storage and transport of the garments. It also may facilitate stacking both horizontally and vertically. In addition, a shirt with an integrated frame in accordance with the principles of the invention may allow viewing of the front of the garment, removal from a stack of garments and insertion of the garment into a stack of garments without causing wrinkling of the garments manipulated.

FIG. 8 shows an alternative embodiment of the flaps 62 and 64 in accordance with the principles of the present invention.

flap 62 has a slit 68 and flap 64 has a corresponding complimentary slit 66. Slits 66 and 68 may interconnect to hold the flaps in place. This may be preferable to using a magnetic pad because it may not require additional materials. Thus if the flaps of FIG. 8 are utilitzed, the entire frame may be comprised of a single unitary body. Other mechanisms may similarly be used, such as for example a tongue and groove mechanism as commonly used with cereal and cracker boxes intended to be opened and closed repeatedly.

FIG. 9 shows an alternative embodiment of a frame 70 in accordance with the principles of the invention. Frame 70 is integrated with a folded shirt 72 and held in a substantially parallelepiped configuration by flap 74. flap 74 includes an upper tab 76 and a corresponding lower groove 78. The frames 70 may be stacked, horizontally or vertically such that tabs 76 align with grooves 78 to facilitate stacking, organizing, storage and display of the garments. Other designs and mechanisms may also be used to facilitate stacking of the frames and integrated garments.

The flaps may be of a rigid or supple material such as for example the flaps may be made of ribbon or cloth, or may be of a rigid material. If the flap material is cloth, ribbon or other supple material, crease 28 and 29 may not be necessary. Optionally, one or more panels or one or more flaps may include ornamentation such as, for example, a logo or trademark of a garment manufacturing company or retail sales company. Optionally, the frame may be infused with a pleasant odor, for example cedar, to improve the smell of the garments with which they may be integrated. Similarly, the frame may incorporate one or more components designed to repel insects as is known for use with moth balls.

FIG. 10 shows an alternative embodiment of a frame 90. Frame 90 may be comprised of front panel 92, secondary panel 96 and rear panel 100. Front panel 92 may be attached to secondary panel 96 by transverse fold 94. secondary panel 96 may be connected to rear panel 100 by transverse fold 98. Flaps 106 and 017 may extend laterally from rear panel 100 and include folds 108 and 109 respectively.

As shown in FIG. 12, a shirt 120 may be placed face-down on a surface and frame 90 may be placed on top of it such that fold 98 is just below shirt bottom 130. A first side 124 of the shirt 120 may include a sleeve 122 and be folded over the frame 90 by folding it along a first crease 125. Similarly, a second side 128 having a sleeve 126 may be folded along a second crease 127.

FIG. 12 shows how the frame 90 may then be folded at folds 94 and 98 after the sides 124 and 128 have been folded over the frame 90 along creases 125 and 127 respectively. When the frame 90 has been folded, the front panel 92 lies on the top and the rear panel 100 lies on the bottom with secondary panel 96 sandwiched between them. The flaps 106 and 107 may be folded over the front panel 92 and engaged to hold the frame 90 and shirt 120 together in a compact shape.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A garment frame comprising:

a front panel;

a secondary panel attached to the front panel by a first transverse fold;

a rear panel attached to the secondary panel by a second transverse fold; and, two flaps extending laterally from the rear panel;

wherein the flaps are capable of folding over the front panel and removably engaging each other when a shirt is folded around the front panel and the secondary panel; and, wherein the frame is folded such that the front panel lies flush with the secondary panel and the secondary panel lies flush with the rear panel.

2. The garment frame of claim 1, wherein the flaps include pads that are capable of removable engagement with each other.

3. The garment frame of claim 2, wherein the pads are magnetically engageable.

4. The garment frame of claim 2, wherein the pads may engage by means of a hook and loop structure.

5. The garment frame of claim 2, wherein the pads are comprised of one or more snaps.

6. The garment frame of claim 2, wherein the pads have a tongue and groove structure.

7. The garment frame of claim 1, wherein the flaps are flexible and may be tied together.

8. The garment frame of claim 1, wherein the frame is comprised of a single unitary body.

9. A garment frame comprising:

a front panel;

a secondary panel attached to the front panel by a first transverse fold;

a tertiary panel attached to the secondary panel by a second transverse fold;

a rear panel attached to the tertiary panel by a third transverse fold and having two flaps extending laterally from the rear panel and capable of removable engagement with each other; and, wherein the flaps are capable of folding over the front panel and removably engaging each other when a shirt is folded around the front panel, the secondary panel; and, wherein the tertiary panel, and the frame is folded such that the front panel lies flush with the secondary panel, the secondary panel lies flush with the tertiary panel and the tertiary panel lies flush with the rear panel.

10. The garment frame of claim 9, wherein the flaps include pads that are capable of removable engagement with each other.

11. The garment frame of claim 10, wherein the pads are magnetically engageable.

12. The garment frame of claim 10, wherein the pads may engage by means of a hook and loop structure.

13. The garment frame of claim 10, wherein the pads are comprised of one or more snaps.

14. The garment frame of claim 10, wherein the pads have a tongue and groove structure.

15. The garment frame of claim 9, wherein the frame is comprised of a single unitary body.

16. The garment frame of claim 15, wherein the flaps include pads that are capable of removable engagement with each other and the frame is comprised of cardboard.

17. A method of folding a shirt comprising:

placing the shirt face-down on a surface;

placing on the shirt a frame having a front panel, a secondary panel attached to the front panel by a first transverse fold, a tertiary panel attached to the secondary panel by a second transverse fold and a rear panel attached to the tertiary panel by a third transverse fold and having two flaps extending laterally from the rear panel and capable of removable engagement with each other;

folding a first side of the shirt along a first crease parallel to the frame such that the first side of the shirt is folded over the frame;

folding a second side of the shirt along a second crease parallel to the frame such that the second side of the shirt is folded over the frame;

folding the frame along the transverse folds such that the front panel lies flush with the secondary panel, the secondary panel lies flush with the tertiary panel and the tertiary panel lies flush with the rear panel;

folding the two flaps over the front panel and engaging them with each other to retain the frame and shirt in a folded configuration.

18. The method of folding a shirt of claim 17, wherein the two flaps are removably engageable by means of a hook and loop mechanism.

19. The method of folding a shirt of claim 18, wherein the frame has a single, unitary body comprised of cardboard.

* * * * *